US005160553A

United States Patent [19]

Leban et al.

[11] Patent Number: 5,160,553

[45] Date of Patent: Nov. 3, 1992

[54] COLD-WORKED STEEL OF HIGH COMPRESSIVE STRENGTH AND ARTICLES MADE THEREOF

[75] Inventors: Karl Leban, Weiner Neustadt; Herbert Schweiger, Wartberg i. Mürztal, both of Austria

[73] Assignee: Bohler Gesellschaft m.b.H., Kapfenberg, Austria

[21] Appl. No.: 601,676

[22] Filed: Oct. 23, 1990

[30] Foreign Application Priority Data

Oct. 23, 1989 [AT] Austria ..... 2423/89

[51] Int. Cl.[5] ..... C22C 38/18; C22C 38/22

[52] U.S. Cl. ..... 148/318; 148/316; 148/317; 148/325; 420/62; 420/63; 420/101; 420/103; 420/122; 420/124

[58] Field of Search ..... 148/318, 316, 317, 325; 420/37, 101, 103, 122, 124, 62, 63

[56] References Cited

U.S. PATENT DOCUMENTS 4,264,380 4/1981 Rose et al. ..... 148/318
4,966,751 10/1990 Kaede et al. ..... 148/318

FOREIGN PATENT DOCUMENTS 0104791 12/1986 China .
1179853 8/1986 Japan .
1-031952 2/1989 Japan .

*Primary Examiner*—R. Dean
*Assistant Examiner*—Sikyin Ip
*Attorney, Agent, or Firm*—Nies, Kurz, Bergert & Tamburro

[57] ABSTRACT

The invention concerns a cold-worked steel of high compressive strength for tools and parts simultaneously subjected to several stresses.

The steel of the invention evinces a composition in % by weight of

C: 0.6 to 1.5
Si: 0.2 to 1.6
Mn: 0.2 to 1.2
Cr: 5.0 to 10.0
Mo: up to 3.0
W: up to 6.0
(Mo+2W): 1.0 to 3.0
V: 0.3 to 1.5
Al: 0.2 to 1.6
Nb: up to 0.5
N: up to 0.1 the remainder being iron and process-entailed contaminations, and it is especially provided for tools and parts comprising an anti-wear layer made at higher temperature.

7 Claims, No Drawings

COLD-WORKED STEEL OF HIGH COMPRESSIVE STRENGTH AND ARTICLES MADE THEREOF

BACKGROUND OF THE INVENTION

The invention concerns a cold-worked steel with high compressive strength and the use of such steel for parts and tools.

Tools and machine parts are made from cold-worked steels where such steels are used for processing materials at temperatures less than 250° C., especially at room temperature. Such processing may be cutting or non-cutting, e.g., stamping, pressing or extruding, the parts or tools being simultaneously subjected to various stresses. As a rule the desired properties of the parts, such as compressive strength, hardness, toughness, wear resistance, cutting life and possibly erosion matching the predominant stresses, shall be achieved by a suitable selection of the composition of the cold-worked steel.

It is known to meet the requirement, for instance, of high wear-resistance to make use of Cr steels with contents of 1.5 to 2.5% C and 10 to 17% Cr, illustratively steels corresponding to DIN material No. 1.2379 or AISI type D7. While such steels in fact do have high wear resistance, on account of their high and coarse carbide proportion, which most of the time is arrayed in lines, its toughness is low, and accordingly the part may fracture or crack when subjected to bending or shearing stresses.

To make cold-worked steel tools of good toughness, it is known to use alloys with about 5% or about 8% Cr and a carbon content of about 1.0% or about 0.5% with additions of Mo, W and V, illustratively steels according to DIN material No. 1.2363 or No. 1.2345 or AISI type A2. In the event of advantageous alloy structure or carbide structure, these steels may have good toughness and adequate erosion and abrasion behavior, but their wear resistance and compressive strength are not satisfactory for some applications. Moreover the alloy variations, namely those with Cr contents of 10 to 17% and those with 5 to 8% Cr, also incur the drawback that upon additional surface hardening by nitridation and/or carbonitridation, or upon surface coating using the CVD or PVD methods at temperatures between 350° and 600° C., the previously achieved improved hardening of the base material shall be reduced.

SUMMARY OF THE INVENTION

The object of the invention is to synergistically exploit the effects of the alloy elements in a specific range of concentration and to create a cold-worked steel of high compressive strength having high hardness, toughness, wear-resistance and erodibility, cutting, stamping and the like tools made from this steel offering good grindability, cutting and wear lives, and which, in the event of surface hardening and/or surface coating carried out at higher temperatures, shall remain substantially adversely unaffected as regards the previously achieved improved mechanical properties of the base material.

This problem is solved by the invention as disclosed in the following detailed description and the appended claims.

GENERAL DESCRIPTION

It is important with respect to the steel of the invention that both the carbon and the nitrogen contents and the elements forming carbides and/or nitrides shall be matched in their concentrations to the carbon and nitrogen affinities and to their tendency to form carbides and/or nitrides.

Excessive contents of C>1.5% entail proportionately large and also coarse carbide grains and thereby poor material toughness, whereas at contents of less than 0.6% the required mechanical properties, in particular hardness, are not achieved. Chromium, molybdenum, tungsten and vanadium are used as added alloying elements when forming carbides, and according to the invention, the particular concentration of these elements accounts for the interaction. It is important in this respect that during heat treatment those carbides shall dissolve which when being tempered at temperatures>500° C. shall precipitate sub-microscopically, cause high hardening, i.e. a secondary rise in hardening and extensive tempering resistance of the steel. Aluminum and silicon are elements which strongly confine the alloy $\gamma$ domain and are required on several grounds. Surprisingly, these ferrite-forming elements do significantly improve the heat-treatment behavior of the steel and its tempering resistance within the claimed ranges of concentrations. Furthermore nitrides are formed at the corresponding nitrogen content of the alloy and they prevent grain growth during hardening or austenization at high temperatures. When surface hardening by nitridization or carbo-nitridization and/or surface-coating by a CVD or PVD method, or the like, aluminum and silicon are advantageously effective. Niobium is strongly carbide-forming, and even finely precipitated niobium carbides will be only slightly soluble at high austenization temperatures.

However high niobium contents at the carbon concentrations of cold-worked steels result in niobium carbide grains which are too coarse, and therefore niobium is added to the alloy only up to a maximum concentration of 0.5%.

It was found in comparison tests that the steels of DIN materials No. 1.2363 and No. 1.2379 have an admissible specific pressure load of 2785 and 3026N/mm$^2$ respectively and a 550° C. tempering hardness of 56 and 60 HRC. The cold-worked steel of the invention has a minimum admissible specific pressure load of 3022N/mm$^2$, a tempering hardness of 63.5 HRC and a toughness which is improved by 28% relative to material No. 1.2379.

The invention is elucidated below in relation to illustrative examples of implementation.

EXAMPLE 1

Similar stamping tools for making valve disks from 17% Cr steel with a strength of 624N/mm$^2$ and 1 mm thick were made from a steel A of the invention with the following composition in % by weight:

C=0.89
Si=0.98
Mn=0.43
Cr=8.96
Mo=1.82
V=0.38
Al=1.33
Nb=0.04
N=0.028 and an alloy D per material No. 1.2379 with the following composition:

C=1.53

Si=0.32
Mn=0.31
Cr=11.15
Mo=0.64
V=0.92

The male and female stamp parts made from steel A had a hardness of 63 HRC and 64,629 stampings could be carried out. In spite of an only slightly lower hardness of 62 HRC of the steel D, it could perform only 20,751 stampings, so that the tool of the invention increased performance by about 300%.

EXAMPLE 2

A steel B with the composition in % by weight as follows:

C=1.09
Si=0.94
Mn=0.36
Cr=8.24
Mo=2.14
W=0.23
V=0.54
Al=1.06
Nb=0.08
N=0.043 and an alloy D as in the previous Example were used for extrusion tools to press aluminum video heads. The surface of the steel B tool was enriched with nitrogen in bath nitridization at about 570° C., and thereupon the hardness of the base material was 63.5 HRC.

This tool performed 407,320 pressing operations without excessive wear appearing, whereas the steel D tool had to be scrapped after 239,865 pressing operations.

EXAMPLE 3

Cold dies for extruding seamless tubing or pipes of Cr—Ni steel were made from steel D, also from steel C with a composition in % by weight of:

C=1.22
Si=0.81
Mn=0.38
Cr=7.63
Mo=2.57
V=1.08
Al=0.47
Nb=0.15
N=0.021 and from a steel G (material No. 1.2363) with composition in % by weight of:

C=0.96
Si=0.34
Mn=0.56
Cr=5.06
Mo=0.93
V=0.18

The following lengths in meter of finished tubing or pipe could be made, i.e. extruded:

steel D=6,120
steel C=12,764 and
steel G=5,087.

What is claimed and desired to be secured by Letters Patent is:

1. An article made from a cold-worked steel with high compressive strength greater than 3022 N/mm$^2$, which has its contents consisting essentially, in % by weight, of the following elements:

C: 0.6 to 1.5
Si: 0.2 to 1.6
Mn: 0.2 to 1.2
Cr: 5.0 to 10.0
Mo: up to 3.0
W: up to 6.0
(Mo+2W): 1.0 to 3.0
V: 0.3 to 1.5
Al: 0.2 to 1.6
Nb: 0.02 to 0.35
N: 0.01 to 0.06 and the remainder of the contents being iron and process-entailed contaminations, and in addition said article has an outer surface anti-wear layer made at a high temperature no greater than 600° C.

2. An article as defined in claim 1, wherein said outer surface anti-wear layer holds higher nitrogen and/or carbon contents and is deposited by one of nitridation, carbonitridation or carburization at temperatures between 350° C. and 570° C.

3. An article as defined in claim 1, wherein said layer is a hard layer and is deposited by one of CVD method or PVD method at temperatures less than 570° C.

4. An article as defined in claim 1, which is a stamping tool.

5. A cold-worked steel with high compressive strength greater than 3022 N/mm$^2$, the contents of which consisting essentially, in % by weight, of the following elements:

C: 0.6 to 1.5
Si: 0.2 to 1.6
Mn: 0.2 to 1:2
Cr: 5.0 to 10.0
Mo: up to 3.0
W: up to 6.0
(Mo+2W): 1.0 to 3.0
V: 0.3 to 1.5
Al: 0.2 to 1.6
Nb: 0.02 to 0.35
N: 0.01 to 0.06 and the remainder of the contents being iron and process-entailed contaminations.

6. A cold-worked steel with high compressive strength greater than 3022 N/mm$^2$, the contents of which consisting essentially, in % by weight, of the following elements:

C: 0.8 to 1.3
Si: 0.7 to 1.4
Mn: 0.3 to 1.2
Cr: 6.0 to 9.0
Mo: up to 3.0
W: up to 3.0
(Mo+2W): 1.0 to 3.0
V: 0.5 to 1.3
Al: 0.4 to 1.4
Nb: 0.04 to 0.3
N: 0.015 to 0.04 and the remainder of the contents being iron and process-entailed contaminations.

7. A cold-worked steel with high compressive strength greater than 3022 N/mm$^2$, the contents of which consisting essentially, in % by weight, of the following elements:

C: 0.9 to 1.2
Si: 0.8 to 1.2
Mn: 0.3 to 1.0
Cr: 7.0 to 9.0
Mo: up to 2.5
W: up to 5.0

(Mo+2W): 1.5 to 2.5
V: 0.6 to 1.2
Al: 0.5 to 1.3
Nb: 0.06 to 0.2
N: 0.02 to 0.035
and the remainder of the contents being iron and process-entailed contaminations.

* * * * *